US006799797B2

(12) United States Patent
Cochran et al.

(10) Patent No.: US 6,799,797 B2
(45) Date of Patent: Oct. 5, 2004

(54) FOLDABLE FURNITURE SUPPORT STRUCTURE FOR CROSS RODS

(75) Inventors: Marian H. Cochran, Hollywood, FL (US); Richard M. Lehrer, Palisades, NY (US)

(73) Assignee: Atico International USA, Inc., Ft. Lauderdale, FL (US)

( * ) Notice: Subject to any disclaimer, the term of this patent is extended or adjusted under 35 U.S.C. 154(b) by 29 days.

(21) Appl. No.: 10/227,471

(22) Filed: Aug. 23, 2002

(65) Prior Publication Data

US 2004/0036322 A1 Feb. 26, 2004

(51) Int. Cl.[7] ..... A47C 4/47

(52) U.S. Cl. ..... 297/16.2; 297/45; 248/164; 403/400

(58) Field of Search ..... 297/16.1, 16.2, 297/45; 108/118; 248/164, 431, 435; 403/394, 396, 400

(56) References Cited

U.S. PATENT DOCUMENTS 647,171 A * 4/1900 Wiles ..... 297/45
1,355,944 A * 10/1920 Dale ..... 108/118
1,845,921 A * 2/1932 Karwoski ..... 248/155.1
2,352,090 A * 6/1944 Faller ..... 297/440.15
2,368,740 A * 2/1945 Blomgren ..... 248/164
4,184,711 A * 1/1980 Wakimoto ..... 297/16.2
5,975,626 A * 11/1999 Aycock ..... 297/16.1
6,270,156 B1 * 8/2001 Metzger et al. ..... 297/16.2
6,302,479 B1 10/2001 Zheng

* cited by examiner

*Primary Examiner*—Peter R. Brown
(74) *Attorney, Agent, or Firm*—Gibbons, Del Deo, Dolan, Griffinger & Vecchione

(57) ABSTRACT

A support structure for foldable furniture to provide support to cross-rods or cross-members when in a crossed, open position and yet permit them to fold into a parallel, closed position. The support structure includes a body having an aperture defined by opposed surfaces and further surfaces. The cross rods or cross-members may rest on or against the further surfaces in their crossed, open position and against the opposed surfaces in their parallel, closed position.

8 Claims, 6 Drawing Sheets

FOLDABLE FURNITURE SUPPORT STRUCTURE FOR CROSS RODS

BACKGROUND OF THE INVENTION

1. Field of the Invention

The present invention relates to support structures for cross rods of foldable furniture. The cross rods may be supported in a cross, open position or be folded into a parallel, closed position.

2. Discussion of Related Art

U.S. Pat. No. 5,975,626 discusses problems with conventional cross-member supporter constructions. It proposes a cross-member supporter for foldable furniture that requires two separate holes, each having a vertical portion and a slanted portion. A cross-member or cross rod is inserted into each of the holes and a bolt extends through both the cross-member and the cross rod and through the supporter. That is, there are three aligned holes in the supporter to accommodate insertion of the bolt. The cross-members or cross rods pivot about the bolt.

It would be desirable to simplify the manufacturing process for a suitable support structure for cross-members or cross-rods of foldable furniture by forming just one, not two separate holes for insertion of the cross-members or cross-rods and by making two, not three aligned holes for insertion of the bolt. Such a reduction simplifies the manufacture and avoids the risk of weakening the integrity of the support structure as may arise where one of the aligned holes passes through a relatively narrow portion between two separate, spaced apart holes that accommodate insertion of the cross-members or cross-rods.

SUMMARY OF THE INVENTION

One aspect of the invention relates to a support structure for foldable furniture, such as foldable chairs and tables. The support structure has a body with an exterior surface and through which extends at most one support slot or aperture, the support slot or aperture being defined by at least two opposed surfaces and further surfaces. At least two cross rods extend through the aperture. A fastening element extends through each of the cross rods and through opposite holes in the body. The cross rods pivot about the fastening element between a crossed, open position and a parallel, closed position. In the crossed, open position, the cross rods rest against respective ones of the further surfaces. In the parallel, closed position, the cross rods rest against the opposed surfaces.

BRIEF DESCRIPTION OF THE DRAWING

For a better understanding of the present invention, reference is made to the following description and accompanying drawings, while the scope of the invention is set forth in the appended claims:

DETAILED DESCRIPTION OF THE DRAWING

Figure 1:
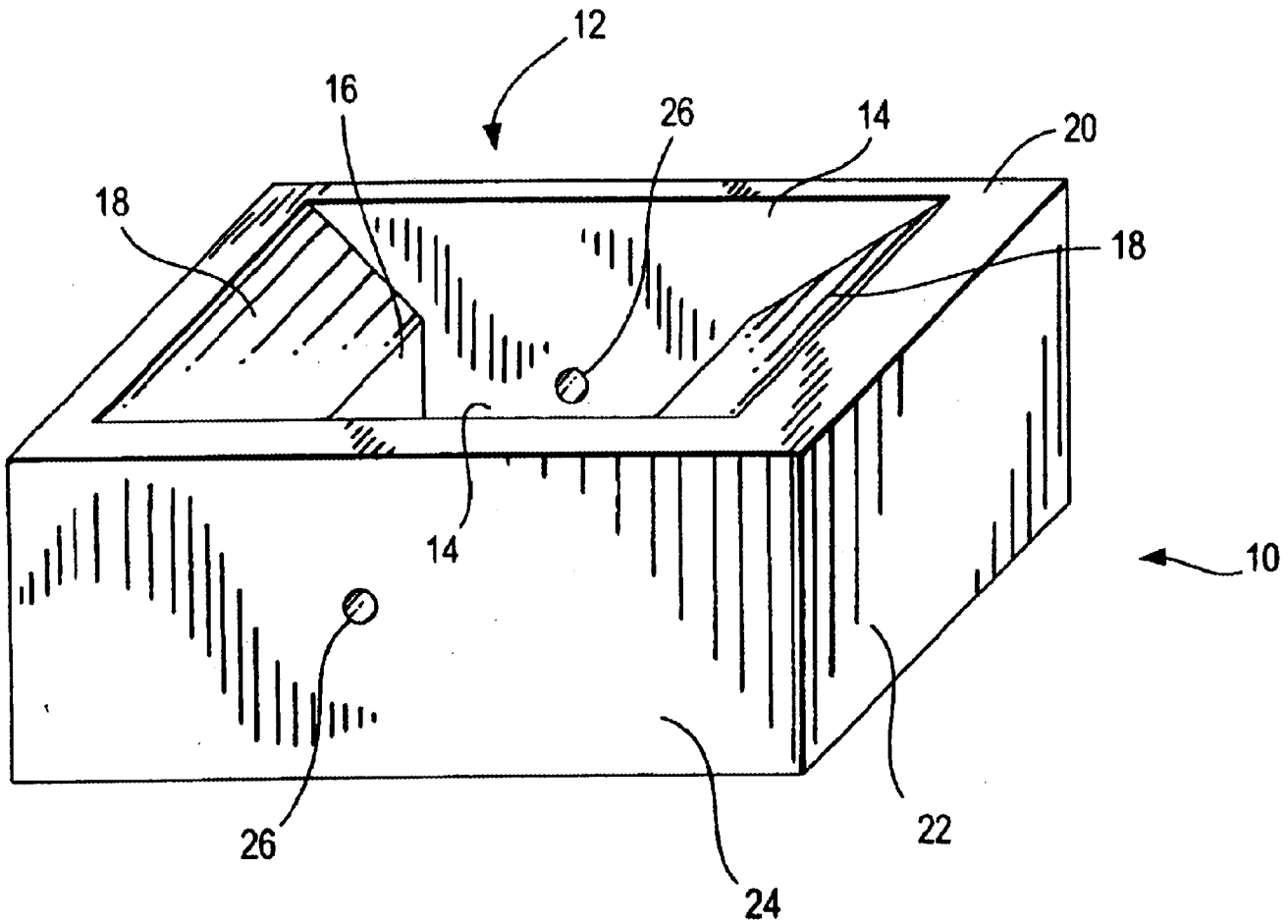
FIG. 1 is a perspective view of a foldable furniture support structure in accordance with a first embodiment.
Figure 2:
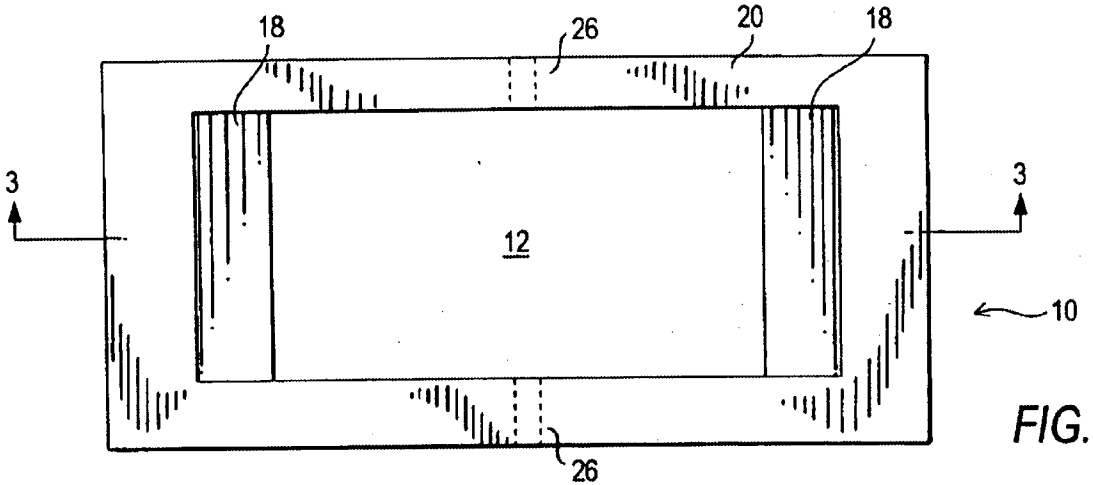
FIG. 2 is a top view thereof.
Figure 3:
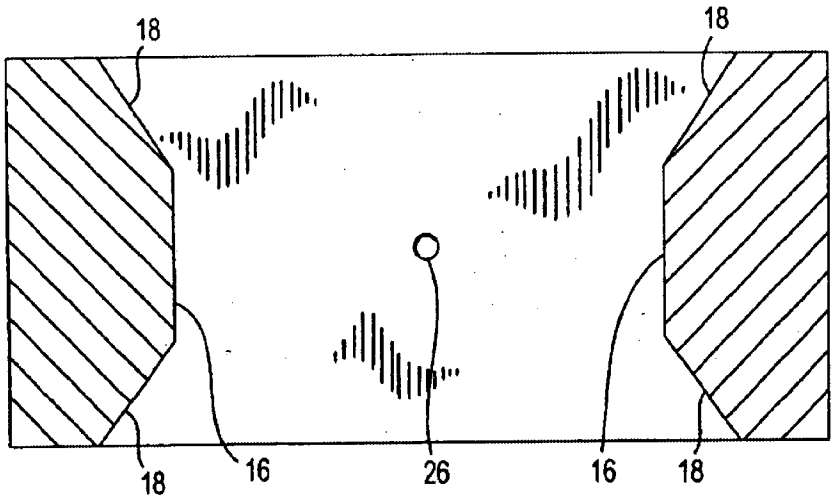
FIG. 3 is a cross-section across 3—3 of FIG. 2

Turning to the drawing, FIGS. 1–3 show a support structure in accordance with a first embodiment. The support structure has a body 10 that defines a through-going aperture 12. The aperture 12 is defined by two side faces 14, two opposed flat surfaces 16, and four inclined surfaces 18. The body has an exterior that includes a top face 20, a bottom face (not shown, but symmetric to the top face 20), a right end face 22, a left end face (not shown, but symmetric to the right end face 22), a front face 24 and a rear face (not shown, but symmetric to the front face 24). Both the front face 24 and the rear face have a through-going hole 26 that is aligned with each other at about a center. Two of the inclined surfaces 18 (e.g., upper supporting groove surfaces) slope toward the top face 20 from respective ones of the two opposed flat surfaces 16 in directions opposite each other. Likewise, the remaining two inclined surfaces (e.g., lower supporting groove surfaces) slope toward the bottom face from respective ones of the two opposed flat surfaces 16 in directions opposite each other. The aperture 12 at the top face and the bottom face form a rectangle.

Figure 4:
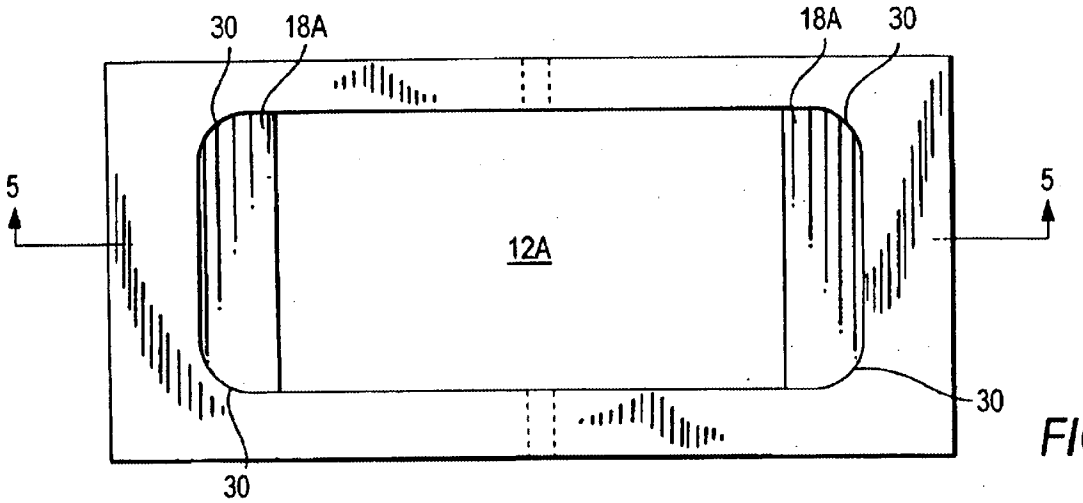
FIG. 4 is a top view in accordance with a second embodiment.
Figure 5:
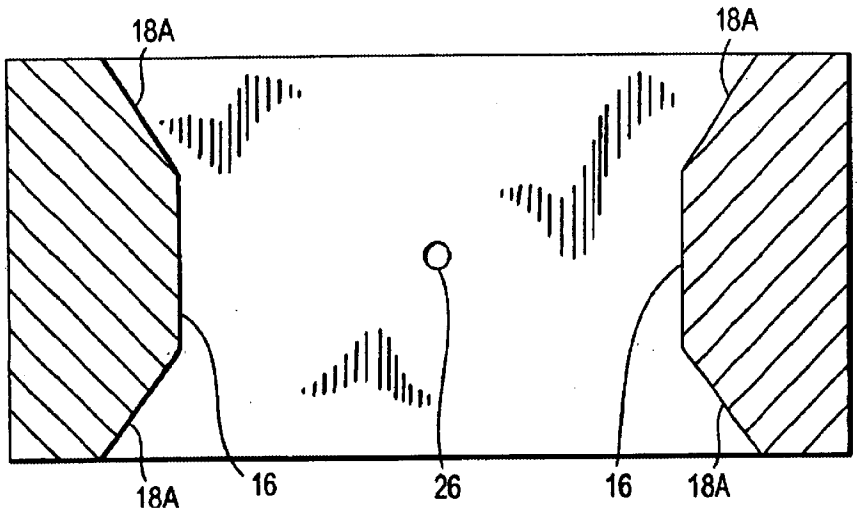
FIG. 5 is a cross-section across 5—5 of FIG. 4.

Turning to the embodiment of FIGS. 4 and 5, the support structure is identical to that of the embodiment of FIGS. 1–3, except that the aperture 12A at the top face and the bottom face is configured as a rectangle with curved corners 30. The inclined surfaces 18A, therefore, terminate at these curved corners 30 as they slope toward the respective top or bottom face.

Figure 6:
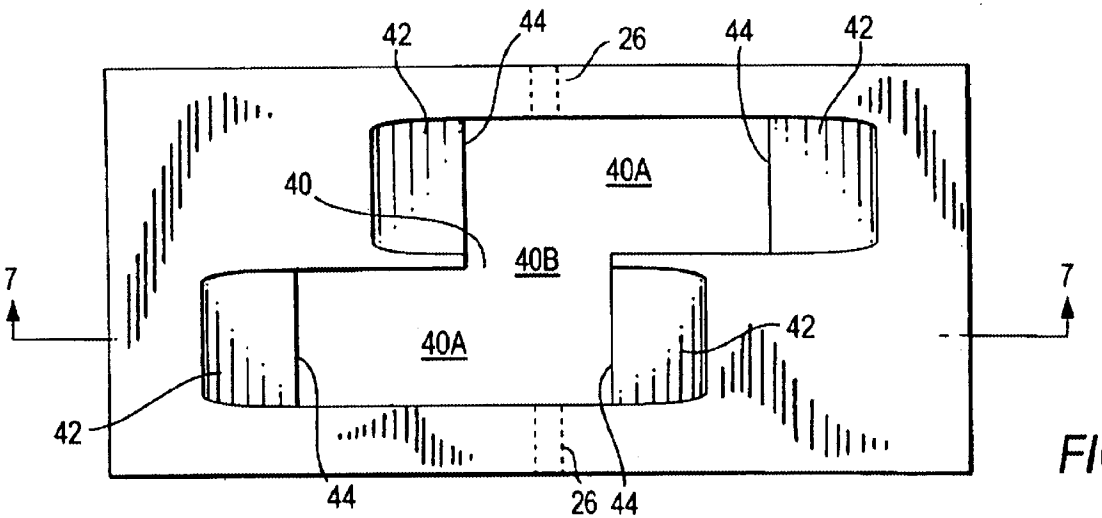
FIG. 6 is a top view in accordance with a third embodiment.
Figure 7:
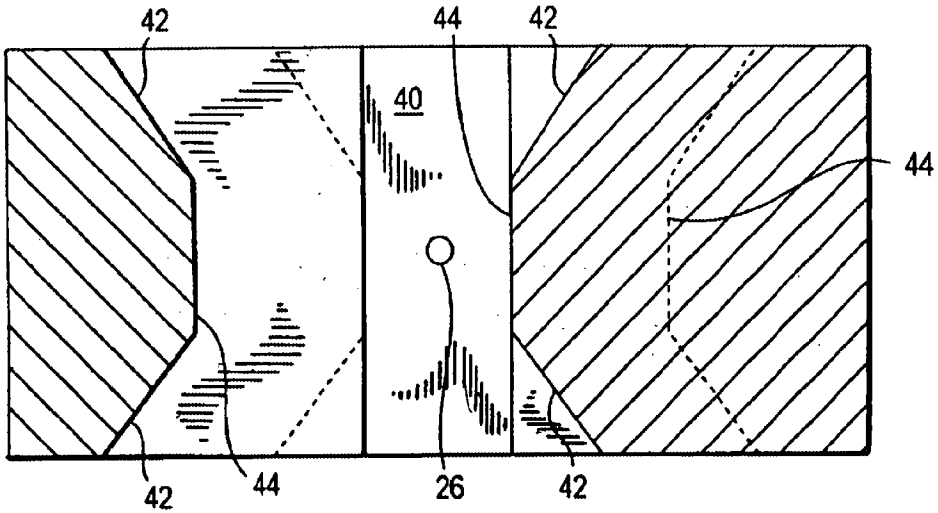
FIG. 7 is a cross-section across 7—7 of FIG. 6.

Turning to the embodiment of FIGS. 6 and 7, the aperture 40 is defined by the inclined surfaces 42 and opposed flat surfaces 44 offset from each other and divided into two spaced apart segments. The aperture 40 includes two, substantially identical elongated portions 40A offset from each other and a joining portion 40B that connects the two elongated portions 40A.

Figure 8:
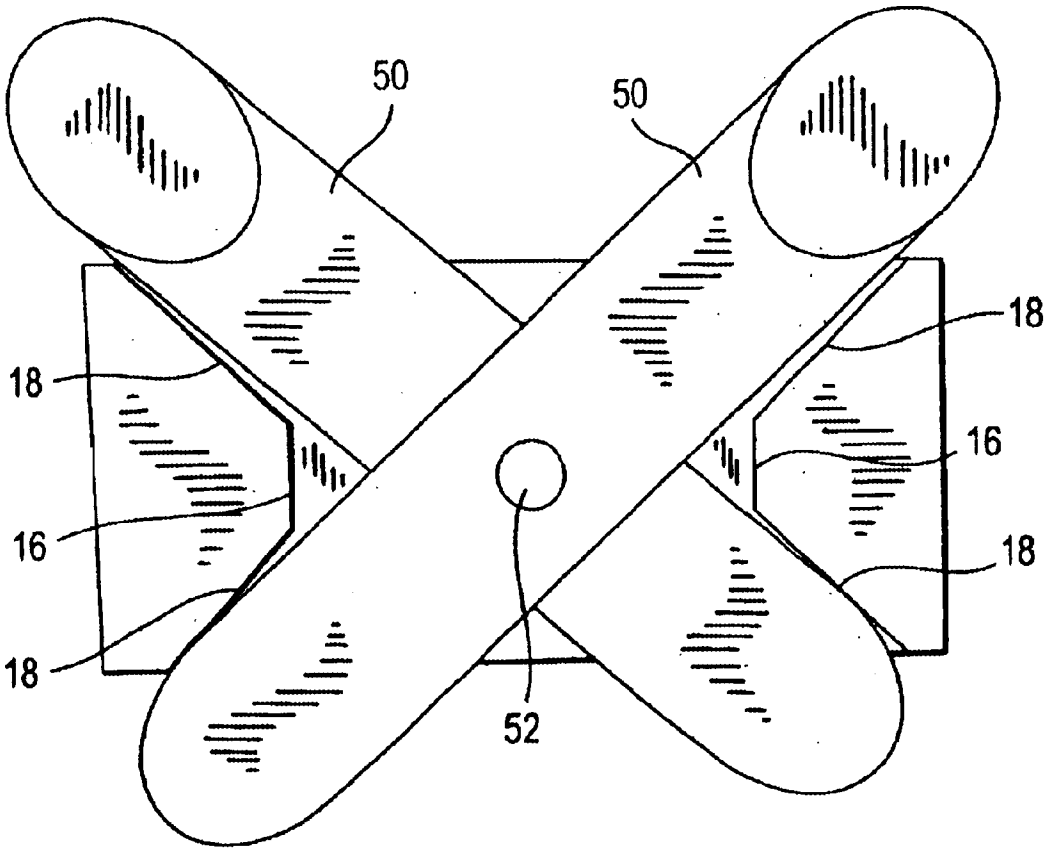
FIG. 8 is a front view showing a bolt securing cross rods in a crossed, open position to the body of the support structure.
Figure 9:
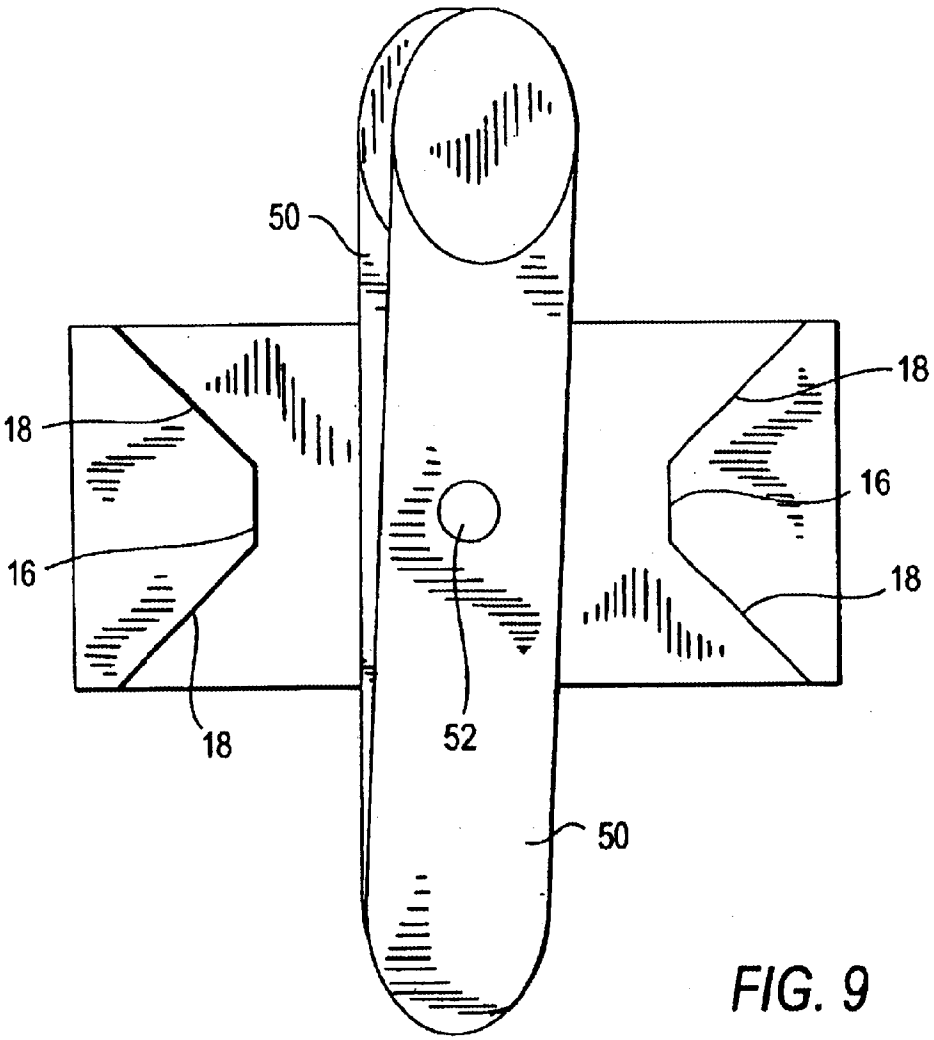
FIG. 9 is a front view showing a bolt securing cross rods in a parallel, closed position to the body of the support structure.

FIG. 8 illustrates the cross rods or cross members 50 being joined together by a bolt 52 in the embodiment of FIGS. 1–3, but which applies in the same manner for the rest of the embodiments. The cross rods 50 may pivot about a bolt 52 between a crossed, open position of FIG. 8 and a parallel, closed position of FIG. 9. The bolt 52 is inserted through the aligned holes 26 and through holes (not shown) in the cross rods and thus has a stem (not shown) that extends the full width of the support structure. A nut may be secured to the end of the bolt that is opposite to the end with the head. The bolt may be replaced by a threaded screw and nut combination or other fastening device.

The cross rods 50, when in the crossed, open position, may rest against the inclined surfaces to which they are in contact, thereby being given additional support. The cross rods 50 may move off the inclined surfaces in the parallel, closed position.

As described, the invention in accordance with the embodiments of FIGS. 1–9 avoids the need to puncture a hole through the middle of the support structure for the bolt since that area is part of the aperture itself. Thus, the support structure in that vicinity does not become weakened by the presence of an additional hole. Since more of the relative volume of the support structure is comprised of the aperture than material for the support structure than is the case for U.S. Pat. No. 5,975,626, there is a savings in material. The cost for manufacturing the die used to make a plastic molded part for forming the support structure is reduced since the formation of the die becomes less complicated. For instance, there is no need to precisely align three holes for the bolt as is the case for U.S. Pat. No. 5,975,626 since at most only two are needed.

If desired, the shape of the aperture at the top and bottom faces for the embodiments of FIGS. 1–5 may be either rectangular, square or elliptical. With respect to the shape of the aperture of the embodiment of FIGS. 6 and 7, the corners of the elongated portions may be either rounded, rectangular or beveled.

The contents of U.S. Pat. No. 5,975,626 are incorporated by reference. Instead of employing spaced apart multiple through-going slots as in that disclosure, the present invention eliminates all the supporter structure between the spaced apart multiple through-going slots of U.S. Pat. No. 5,975,626 to form at most one slot in the support body. Where multiple screws or bolts are employed, as is the case where three cross-rods or cross-members are used such that three screws or bolts are employed, the ends of the screws or bolts pass through the cross-rods or cross-members to enter into a common void or space between the cross-rods or cross-members and may be secured to respective nuts.

While the foregoing description and drawings represent the preferred embodiments of the present invention, it will be understood that various changes and modifications may be made without departing from the spirit and scope of the present invention.

What is claimed is:

1. A cross-member supporter adapted to pivotally connect at least two elongated stems of a foldable furniture, comprising:

a supporter body having at most one connecting hole bounded by inclined surfaces and vertical surfaces from which the inclined surfaces incline, said at most one connecting hole also being bounded by opposite surfaces through which extend at most one pair of aligned supporting through slots, said inclined surfaces being constituted by a pair of upper groove surfaces that incline in different directions relative to each other and a pair of lower groove surfaces that incline in different directions relative to each other, said at least two elongated stems being penetrated through and pivotally connected at said at most one pair of aligned supporting through slots, wherein each of said elongated stems is capable of inclined resting and being supported by a respective one of said upper supporting groove surface and said lower supporting groove surface so as to form a cross construction.

2. A cross-member supporter, as recited in claim 1, wherein said supporting through slot is provided parallel on said supporter body to said vertical surfaces.

3. A cross-member supporter, as recited in claim 1, further comprising a connecting means for pivotally connecting said stems at said pair of aligned supporting through slots.

4. A cross-member supporter, as recited in claim 3, wherein said connecting means comprises a bolt and a nut, a transverse through hole penetrating through walls of said supporting through slot being provided on said supporter body, wherein said bolt is inserted through said transverse through hole at one side of said supporter body and locked in position by said nut at another side of said supporter body.

5. A support structure for foldable furniture, comprising a body with an exterior surface and through which extends at most one support aperture bounded by internal facing surfaces, the internal facing surfaces including at least two opposed surfaces that face opposite each other and at least two further surfaces that incline from respective ones of the at least two opposed surfaces; at least two cross rods extending through the aperture; a fastening element extending through each of the cross rods and through opposite holes in the body, the cross rods being configured to pivot about the fastening element between a crossed, open position and a parallel, closed position so that in the crossed, open position, the cross rods rest against respective ones of the further surfaces and in the parallel, closed position, the cross rods move out of contact with the further surfaces.

6. A support structure as in claim 5, wherein the aperture has a shape at the exterior that has a contour of a rectangle, ellipse or square.

7. A support structure as in claim 5, wherein the further surfaces are constituted by at least two pairs of opposing surfaces that incline in opposite directions.

8. A support structure as in claim 7, wherein said pair of opposing surfaces converge inwardly toward each other as they incline.

* * * * *